US006102652A

United States Patent [19]

Shaver et al.

[11] Patent Number: 6,102,652

[45] Date of Patent: Aug. 15, 2000

[54] SYSTEM AND METHOD OF STORING LOOSE COPY FROM A PRINTING PRESS

[75] Inventors: Robert L. Shaver, Brighton; Alfred J. Kafka, Wixom; Matthew C. Carey, Holt, all of Mich.

[73] Assignee: Jervis B. Webb Company, Farmington Hills, Mich.

[21] Appl. No.: 09/237,976

[22] Filed: Jan. 27, 1999

Related U.S. Application Data

[62] Division of application No. 08/781,808, Jan. 10, 1997

[60] Provisional application No. 60/009,943, Jan. 16, 1996.

[51] Int. Cl.[7] ..... B65H 29/00

[52] U.S. Cl. ..... 414/809

[58] Field of Search ..... 414/398, 528, 414/679, 809; 198/347.3, 603, 606, 604, 462.2

[56] References Cited

U.S. PATENT DOCUMENTS

| | | | |
|---|---|---|---|
| 4,007,824 | 2/1977 | Reist | 198/462 |
| 4,078,648 | 3/1978 | Hinchcliffe et al. . | |
| 4,201,507 | 5/1980 | Hinchcliffe et al. . | |
| 4,423,996 | 1/1984 | Applegate et al. | 414/398 |
| 4,509,703 | 4/1985 | Grunder | 242/59 |
| 4,548,404 | 10/1985 | Brandt et al. | 198/462 |
| 4,569,488 | 2/1986 | Baltisberger . | |
| 4,712,964 | 12/1987 | Van Elten et al. . | |
| 4,837,911 | 6/1989 | Noble . | |
| 4,872,543 | 10/1989 | Hinchcliffe . | |
| 5,018,618 | 5/1991 | Sjorgen | 198/347.3 |
| 5,029,843 | 7/1991 | Kobler | 198/347.3 |
| 5,094,443 | 3/1992 | Young, Jr. | 198/626.2 |
| 5,121,825 | 6/1992 | Sjorgen . | |
| 5,181,820 | 1/1993 | Sjorgen et al. | 414/348 |
| 5,437,537 | 8/1995 | Sweet et al. | 414/401 |
| 5,909,798 | 6/1999 | Shaver et al. | 414/398 |
| 5,975,282 | 11/1999 | Shaver et al. | 198/603 |

FOREIGN PATENT DOCUMENTS

3831475 A1 9/1988 Germany .

*Primary Examiner*—Douglas Hess
*Attorney, Agent, or Firm*—Dickinson Wright PLLC

[57] ABSTRACT

A system for rapidly receiving and storing a quantity of loose copy, for example newspapers, from a high speed printing press and dispensing them to the point-of-use without having to undergo the traditional operation of bundling the newspapers. More particularly, the present invention relates to a newspaper delivery system comprising a conveyor system for receiving a continuous stream of loose, unbound, newspapers directly from a high speed printing operation, an over-the-road vehicle having a cargo area equipped with a loose copy storage unit for receiving the loose newspapers supplied by the conveyor system and storing the newspapers during transport; and mechanism for dispensing a selected quantity of newspapers once the truck arrives at a delivery destination.

8 Claims, 8 Drawing Sheets

SYSTEM AND METHOD OF STORING LOOSE COPY FROM A PRINTING PRESS

CROSS-REFERENCE TO RELATED APPLICATIONS

This application is a division of U.S. application Ser. No. 08/781,808, which was filed on Jan. 10, 1997.

This application claims the benefit of U.S. Provisional Application No. 60/009,943, filed Jan. 16, 1996 which is herein incorporated by reference.

FIELD OF THE INVENTION

The present invention relates to a method and apparatus for receiving, storing and dispensing a succession of loose copy of printed material, such as newspapers. More particularly, this invention relates to a method and apparatus for receiving and storing a high speed stream of newspapers and dispensing individualized quantifies on demand.

BACKGROUND OF THE INVENTION

Newspapers go through three basic stages before reaching the consumer. These stages are commonly referred to as the press room, mailroom and circulation stages. During the press room or printing stage, the newspapers are printed, cut and folded into complete papers at very high speeds. Typically the papers are presented at the end of the press stage as a high speed stream of partially overlapped newspapers.

Currently, at the mailroom stage, newspapers are arranged in stacks and bundled for distribution to various locations. The stacking and bundling operation is an expensive procedure that employs extensive complex equipment. These bundles may be stacked in either fixed quantities or in predetermined quantities directed to a definite ultimate distribution point. The made to order sized bundle complicates the stacking and bundling operation as well as the circulation stage because it requires the bundles to be individually tracked.

Complete bundles are delivered from the mailroom facility into the circulation stage. Typically, the bundles are conveyed directly to the trucks where the bundles are manually removed from the conveyor and loaded into the cargo space on the truck. This manual loading operation is slow and tedious and, since it is highly labor intensive, significantly increases the operating costs for the circulation stage.

In order to address this industry problem, systems were developed to automate the circulation stage. Such systems comprise loading carts and automatic cart loaders, such as those described in U.S. Pat. Nos. 5,181,820 and 5,437,537, that were used to receive bundles from the mailroom and place bundles into the carts. The carts were then manually wheeled into the cargo space of the truck. The carts were dimensioned so as to make the most economic use of the total cargo space volume. When the trucks reached their destination the carts were removed from the cargo space and unloaded.

Although these automated systems helped make better use of the cargo space and reduced some of the manual operations, these systems still involved the manual loading and unloading of the cargo space and did nothing to address the stacking and bundling operation in the mailroom stage. Furthermore, the newspapers were still in stacked bundles at the point of ultimate distribution to the retailers, door-to-door deliverers, and honor boxes. This meant that either individual bundles of predetermined quantities of newspapers needed to be prepared, individually tracked through the entire circulation stage, and delivered to this ultimate distribution point or the bundles needed to be broken apart and separated at the distribution point in order to deliver the required amount of newspapers. It is clear that the prior art newspaper systems involved numerous semi-automated and manual steps which required costly equipment, labor and time to receive the newspapers from the print room stage to the ultimate distribution point.

Since the uninterrupted operation of the printing press is of premium importance, there may be additional equipment, for instance, between the pressroom and mailroom stage to provide a buffer between the two. For example, if the stacking and bundling equipment were to be inoperable, the printing press could continue to operate provided the stream of papers could be diverted to a buffer. Heretofore, the buffer system included a helical ramp with vertical shaft. The succession of newspapers was caused to run up the ramp. This was problematic because the newspapers would slide and turn resulting in ink becoming smudged and papers becoming creased.

Another buffer system involved a drum where the papers were rolled onto the drum with the aid of a strap. This system also had a number of drawbacks and limitations in that it only provided minimal storage capacity and required large portions of valuable floor space in order to operate. U.S. Pat. No. 5,018,618 discusses a system that required significantly less floor space than the operating space required for the drum. This system involved a vertically rising shelf unit that straddled the conveyed stream of newspapers and engaged the outside edges of the newspapers. This shelf unit lifted the papers vertically and held them in storage. The unit required an upstream device to divide the succession of newspapers into longitudinal sections so that stacks of newspapers could be positioned on each shelf.

The cigarette industry uses a vertically stacked horizontal conveyor to temporarily store cigarettes. This system, described in U.S. Pat. No. 4,201,507, is designed for conveying and temporarily storing rod-like articles (cigarettes or cigarette filter rods). This system handles multiple layers of free flowing cigarettes bounded at the leading end by a closure device and on the top and bottom by conveyors. The leading end closure device is carefully designed to pass through the unit's zig-zag conveyor path. The movement of the cigarettes is controlled by the movement of the end closure device as the cigarettes are not discretely held within the unit. As the end closure device moves forward in the storage unit, it creates an ever enlarging cavity defined by the upper and lower conveyors and the backface of the closure device. The layered stream of free-flowing cigarettes is continuously pumped into this progressive cavity to fill the storage device.

Once the cavity is filled, the input opening of the storage device is closed off to hold the back face of the free-flowing cigarettes in the storage unit. In order to maintain a continuous full flow of cigarettes, the system is equipped with an elevator that provides a vertical cavity for allowing the formation of a full path of cigarettes.

The movement of the free-flowing cigarettes in this system is analogous to water being pumped through a pipe. The cigarettes are not held fixed with respect to each other or the conveyor surface. Therefore, the mass of cigarettes moves freely within the zig-zag path of the system. The system is incapable of individually dispensing cigarettes as it only controls the movement of the closure device nor is it capable of maintaining the relative position of the cigarettes.

It is therefore an aspect of the present invention to provide an automated system for receiving newspapers at a speed equal to or exceeding the industry printing standards, storing the papers in a fixed relationship which minimizes damage to the newspapers such as print smudging and paper creasing, and dispensing the newspapers on demand in either discrete quantities or as a continuous stream.

It is another aspect of the present invention to provide a system for receiving, storing, and delivering newspapers from a printing press to the ultimate distribution point without requiring the papers to be bundled.

It is still a further aspect of the present invention to provide a system for automatically receiving newspapers from a printing press, storing them in a fixed relationship and automatically dispensing individual quantities of newspapers at a remote location.

It is still a further aspect of the present invention to provide an automated system for receiving, holding and re-introducing a continuous stream of newspapers.

It is yet another aspect of the present invention to provide an automated high volume per unit area newspaper storage unit that firmly holds each newspaper and is capable of selectively dispensing newspapers.

It is yet another aspect of the present invention to provide an automated continuous conveyor system comprising a series of closely arranged vertically stacked conveyors that receive, hold, and dispense newspapers.

SUMMARY OF THE INVENTION

The invention involves a system for receiving and storing a quantity of loose copy, for example newspapers, from a printing press and dispensing them to the point-of-use without having to undergo the traditional operation of bundling the newspapers. More particularly, the present invention relates to a newspaper delivery system comprising a conveyor system for receiving a continuous stream of loose, unbound, newspapers directly from a high speed printing operation, an over-the-road vehicle having a cargo area equipped with a loose copy storage unit for receiving the loose newspapers supplied by the conveyor system and storing the newspapers during transport; and means for dispensing a selected quantity of newspapers once the truck arrives at a delivery destination.

It should be appreciated that the term newspaper is used throughout the specification as an example of a type of loose copy. It should be understood that while newspaper is an example of loose copy the present invention is not limited to newspaper but rather extends to all types of loose copy, such as magazines, flyers, and the like.

In a preferred embodiment of the present invention, the transfer conveyor which transports the loose copy from the printing press to the storage unit comprises a pair of band conveyors each having a series of spaced apart rollers and a plurality of elastic bands strapped around the rollers in a spaced apart parallel arrangement. The space between the pair of conveyors is sized to maintain and allow passage of a stream of partially overlapped newspapers to pass there within. The pair of band conveyors are designed to support and convey a continuous stream of partially overlapped newspapers in virtually any orientation.

When the transfer conveyor is in a sloped orientation, the lower run of the upper band conveyor contacts the top surface of the stream of newspapers and holds each paper against the support surface, upper run, of the lower band conveyor. The two runs of the pair of conveyors are synchronized to travel in the same direction and at the same speed.

A series of paired band conveyors may be used to convey a stream of papers from the high speed press to a delivery truck, which may be positioned, for instance, at a loading dock. The delivery truck is equipped with a loose copy storage unit. More specifically, the storage unit comprises several vertical stacks of substantially horizontal band conveyors for handling a continuous or non-continuous stream of newspapers. Each vertically stacked band conveyor has postioned at each end a diverter plate or conveyor. These diverters are used to direct the stream of newspapers either up onto the conveyor above or down to the band conveyor below depending on the positioning of the diverters and/or direction of travel of the paired band conveyors.

The stacked conveyors and associated diverters are arranged so that there is a continuous conveyor path connecting all of the conveyors in a stack and each stack with each adjacent stack. All the diverter band conveyors and each of the multitude of support/confinement conveyors in the storage unit are synchronized and may be gang driven from a single power source.

The stream of newspapers is supplied to a predetermined input position on the storage unit. Typically, this input position will be located either at the top or bottom conveyor in one of the end stacks on the storage unit. The papers can be conveyed from this input point in a serpentine fashion all the way through the storage unit until the leading edge of the stream of newspapers reaches the end of the last conveyor in the unit, ie. the truck is full. The truck is then driven to make deliveries while the loose papers are held firmly in position by the upper and lower runs of the stacked conveyors. Once the delivery truck arrives at a delivery destination, the storage unit on the truck is operated to dispense an individually selected quantity of papers.

Optionally, the newspapers can be charged directly into a delivery box (replaces an honor box) positioned at the entry/exit of the stacked conveyor system. The delivery box is internally equipped with a series of stacked conveyors, similar to the loose copy storage unit, for receiving and dispensing newspapers on demand.

The following description provides a more detailed description of how the newspapers travel within the storage unit. It should be understood that the storage unit can be reversed or designed in a variety of arrangements. In operation, the stream of newspapers is fed onto the support surface of the first conveyor at the input position of a series of stacked conveyors, which is typically located at the top comer at one end of the unit. The stream is conveyed along the length of this first conveyor. Upon reaching the end, the stream is directed downwardly by a diverter onto the band conveyor positioned directly below the first conveyor. The papers remain in contact with what was the support surface and is now the confining bottom surface of the first conveyor as it returns toward the inlet end, one conveyor level down.

This serpentine process continues until the front edge of the stream of papers reaches the bottom conveyor of the first stack. At this point, the stream is fed onto a cross-over conveyor that is canted or otherwise directed over toward the lower entry end of a second stack of vertical conveyors. This second stack of vertical conveyors is positioned immediately adjacent to the first stack. The stream of newspapers is then conveyed in a serpentine fashion up this stack of conveyors until it reaches the top conveyor. At this point, the stream is, again, canted or otherwise directed over to a third conveyor stack where it serpentines through to the bottom conveyor. This travel up one stack and down the next is continued until the front edge of the stream reaches the bottom (or top) conveyor of the last vertical stack. At this point, the series of vertically stacked band of conveyors is full even if the stream is non-continuous throughout the storage space in the loose copy storage unit.

This loose copy storage unit can be positioned at an intermediate point between the printing press and the loading dock or at a remote location to provide readily accessible automatic buffering capacity. Specifically, the storage unit could be positioned to receive and store a stream of newspapers during periods when there are no trucks available or to hold portions of newspapers, for example Sunday edition inserts, for readily accessible delivery in the future. These storage units could be used in any point, within the circulation stage, where it is useful to hold a portion of a stream of newspapers and/or maintain a readily accessible quantity of newspapers.

DETAILED DESCRIPTION OF THE INVENTION AND THE PREFERRED EMBODIMENTS THEREOF

Figure 1:
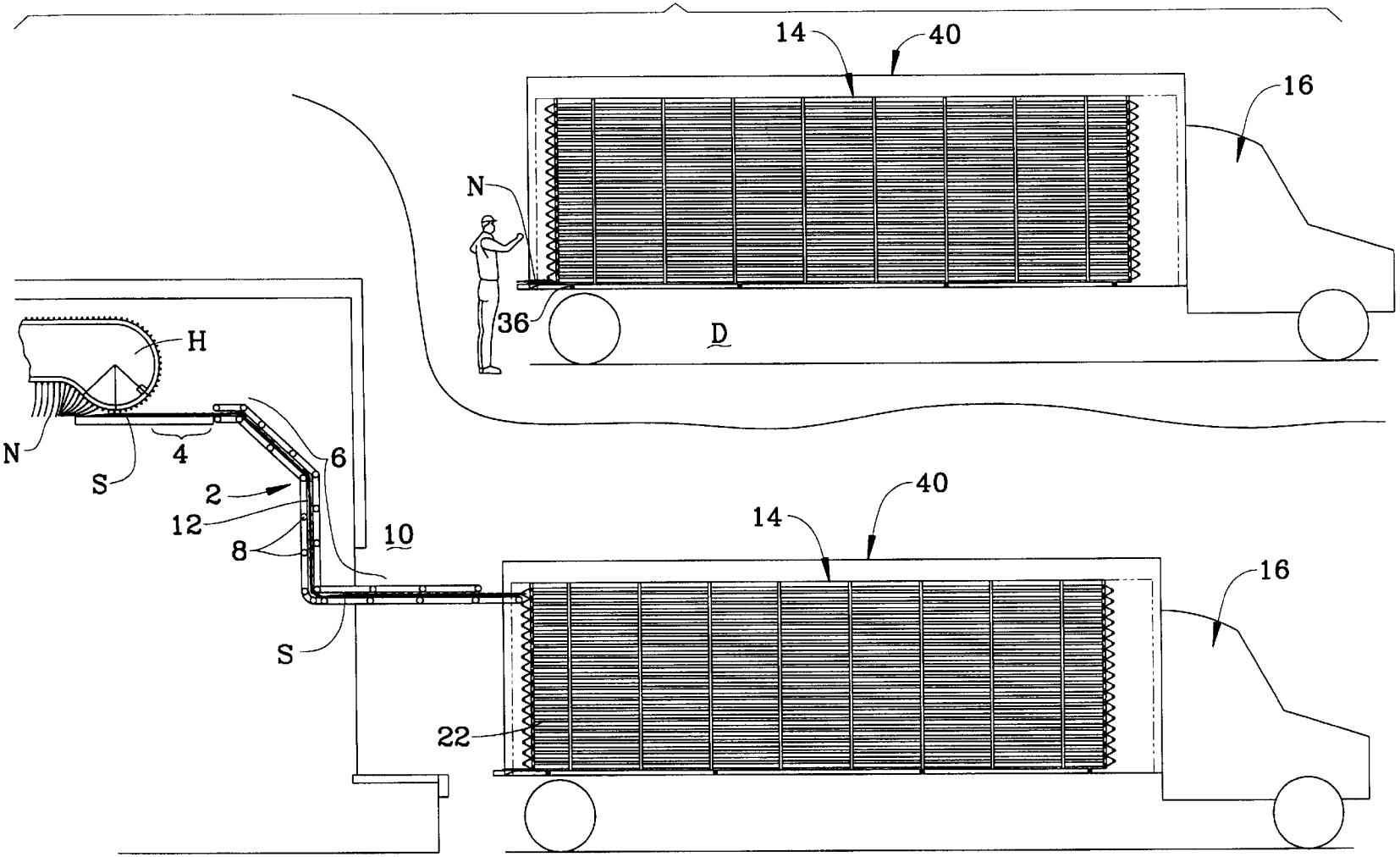
FIG. 1 is a side elevation view of a system designed in accordance with the principles of the present invention.

FIG. 1 shows a system 10 designed in accordance with the principles of the present invention where a continuous or non-continuous stream of loose copy, such as newspapers N, enters the system from the printing press's hanger conveyor H. A transfer conveyor system 2 cooperatively receives the newspapers N from the hanger conveyor H in a manner forming a stream of newspapers S that are in a substantially flat partially overlapped arrangement with the folds of the newspapers N facing forward and the sides of the newspapers substantially in alignment. The relative speed between the hanger conveyor and the transfer conveyor system 2 is adjustable so that the overlap of the newspapers N in the stream can be adjusted depending on the thickness of the newspapers. The transfer conveyor system 2 transports the stream S to an input position of a loose copy storage unit 14. The loose copy storage unit receives the stream S and holds the newspapers in a substantially fixed relationship within the stream. The loose copy storage unit may be positioned in a cargo space of an over-the-road vehicle 16. The vehicle 16 can transport the loose copy storage unit 14 to a remote delivery point D where a select quantity of individual newspapers N are dispensed by the loose copy storage unit 14.

The transfer conveyor system 2 may be composed of single 4 and/or paired endless loop conveyors 6. Preferably, the transfer conveyor system will comprise at least one band conveyor having a series of idler rollers 8, at least one of which is a drive roller, and a plurality of elastic bands strapped around the series of rollers in a spaced apart parallel arrangement. The paired conveyors will comprise two spaced apart conveyors positioned on each side of the stream S of newspapers. The paired conveyors are designed to support, confine and transport the stream S of partially overlapped newspapers in virtually any orientation. The space 12 between the paired conveyors is preferably sized to firmly hold each newspaper of the passing stream S.

Figure 2:
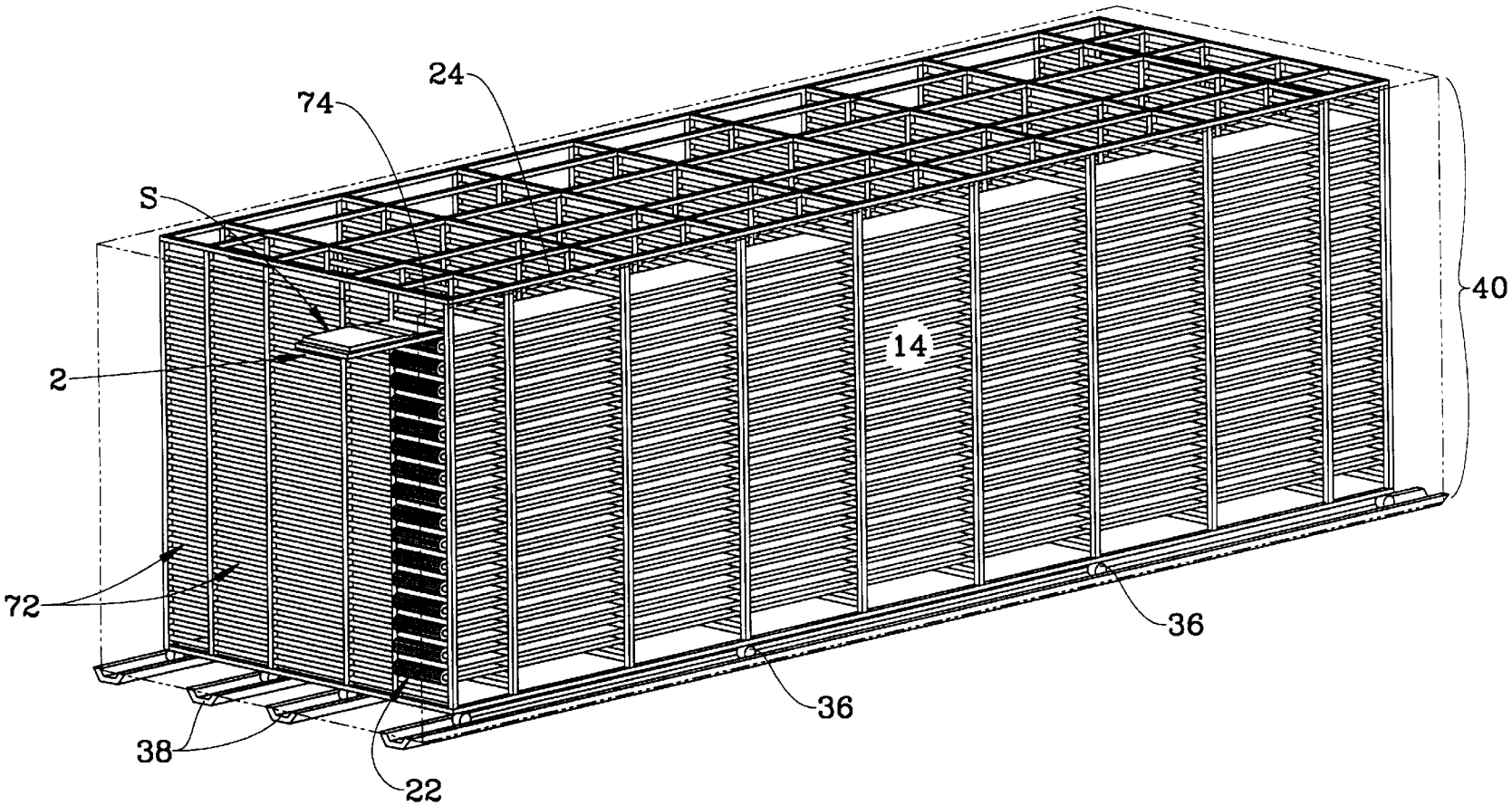
FIG. 2 is a perspective view of a loose copy storage unit in accordance with the present invention, shown equipped with casters positioned in tracks mounted in a vehicle cargo space (shown in phantom).
Figure 7:
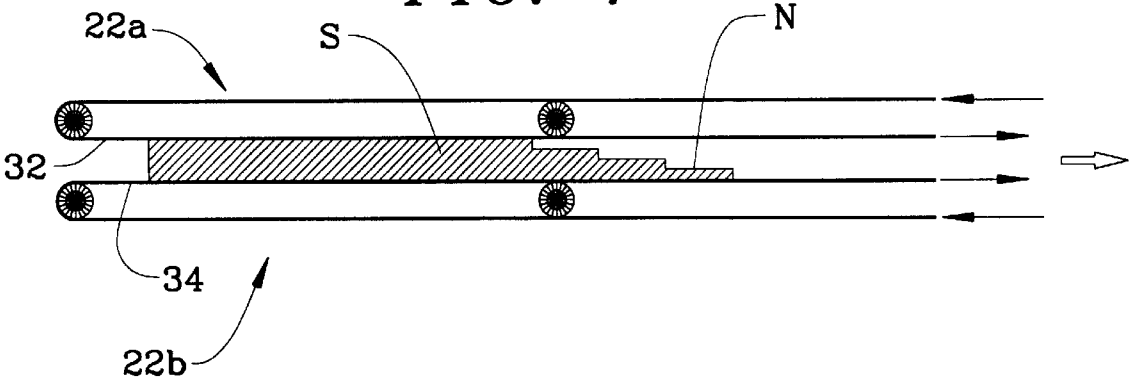
FIG. 7 is a side elevation view of two vertically arranged conveyors with a stream of newspapers positioned therebetween.

The loose copy storage unit 14 comprises at least one vertical stack having a series of closely spaced, longitudinally aligned, endless loop conveyors 22 arranged within a rigid frame 24 forming a serpentine conveyor path, as shown in FIG. 2. The frame 24 provides sufficient structural integrity so that it can support the conveyors when fully loaded and, if the unit is designed for placement in a vehicle, able to withstand the rigors of being transported. The spacing between the conveyors should be sized, as best shown in FIG. 7, such that the bottom run 32 of an upper conveyor 22*a* and the top run 34 of a vertically adjacent lower conveyor 22*b* are in contact with a portion of the upper and lower surfaces, respectively, of each newspaper N. This not only assures that each newspaper is firmly held therebetween but also enables more conveyor runs, and therefore more storage capacity, to placed in a unit area. Preferably, the spacing will be substantially uniform throughout the serpentine conveyor path.

The loose copy storage unit 14 may be provided with casters or wheels 36 to simplify movement of the unit in and out of a vehicle's cargo space 40, as shown in FIG. 2. The cargo space 40 can optionally be equipped with tracks 38 for receiving the caster or wheels 36 of the storage unit 14 and guiding the storage unit into position within the cargo space 40. The tracks can be adapted with a locking mechanism to lock the storage unit 14 in place in the cargo space 40.

Figure 6:
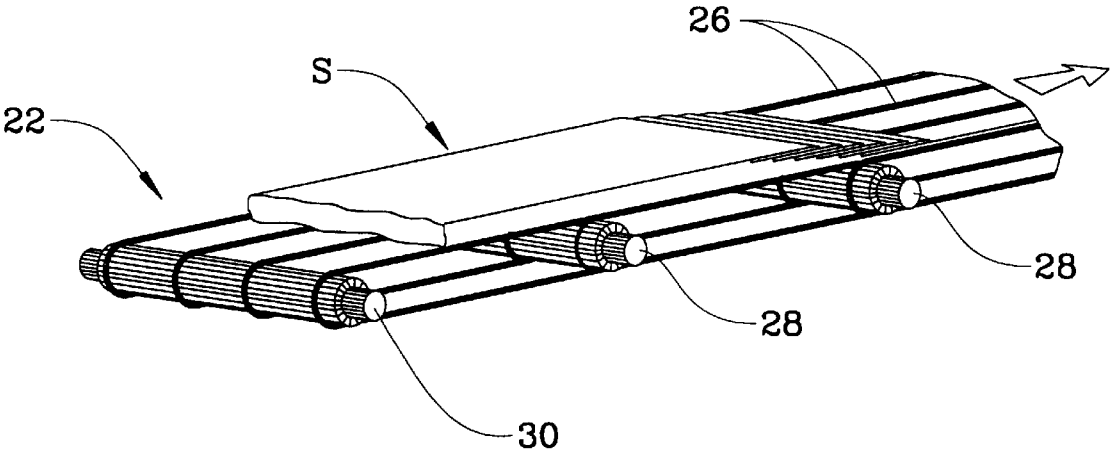
FIG. 6 is an enlarged view of a band conveyor shown in FIG. 1 with a partially overlapped stream of newspapers positioned atop the conveyor.

The conveyors 22 may be belt, band, or other suitable type conveyors. Preferably, the conveyors will be band conveyors, as best shown in FIG. 6, comprising a series of spaced apart parallel elastic bands 26 arranged on a series of idler rollers 28 with at least one driven roller 30. Band conveyors offer a relatively lightweight and compact conveyor which enables more conveyors to be placed within a unit area while requiring less structural support. The parallel elastic bands 26 and rollers 28 & 30 should be arranged to adequately support the newspaper stream S. The individual conveyors will preferably extend substantially the length of the structural frame with the rollers 28 and/or 30 defining the ends of the conveyors substantially aligned within the same vertical plane proximate with the ends of the frame.

It should be appreciated that the rollers may be vertically and/or horizontally adjustable within the frame. This adjustment may be mechanically linked so that groups of rollers can be adjusted in unison for instance to accommodate a different stream S thickness. The rollers of vertically adjacent conveyors may be in vertical alignment with each other or may be offset one from the other depending on the application.

The stream S of newspaper is conveyed to the end of a band conveyor and is guided around the end roller 61 by means of a diverter, as shown in FIGS. 8–10 & 18. The diverters are designed to change the direction of the product stream 180° by guiding the stream S either up or down, depending on the direction of travel of the conveyors and the arrangement of the diverter about the end of the conveyor. The diverters can be passive, such as mechanical diverter plates 42 (see FIG. 8), or active, such as diverter conveyors 62 & 132 (see FIGS. 9, 10 & 18), or the system may employ some of both types.

Figure 8:
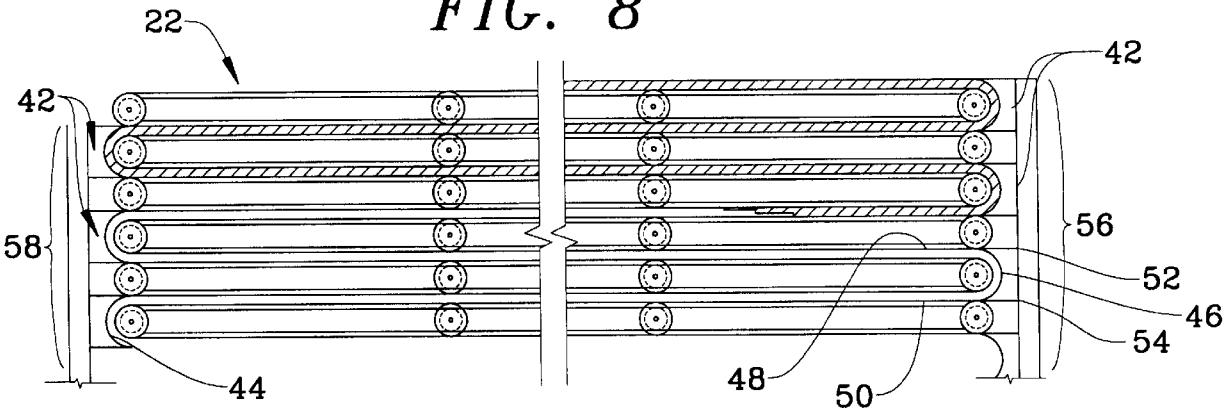
FIG. 8 is a side elevation section view of the loose copy storage unit of FIG. 2 fitted with diverter plates.

A mechanical diverter comprises a curved surface 44 positioned apart from and substantially straddling an end of a conveyor with the apex 46 of the curved surface substantially in-line with the axes of the conveyor rollers, as best shown in FIG. 8. In this straddle position, the curved surface should be sized so that the lower surface 48 of the conveyor immediately above and the upper surface 50 of the conveyor immediately below tangentially align with the respective ends 52 & 54 of the curved surface 44. The group of diverters 56 on one end of the frame will be arranged so that they are positioned at the ends of every other conveyor, for instance the $1^{st}$, $3^{rd}$ and $5^{th}$ conveyors. On the opposing end, the group of diverters 58 will be offset so that they are positioned at the ends of the other conveyors, for instance $2^{nd}$, $4^{th}$ and $6^{th}$ conveyors. Therefore, each conveyor 22 will have a diverter centered about only one end of the conveyor. The stacked conveyors 22 in conjunction with the diverter plates 42 arranged in this fashion forms the serpentine conveyor path within the storage unit.

Figure 9:
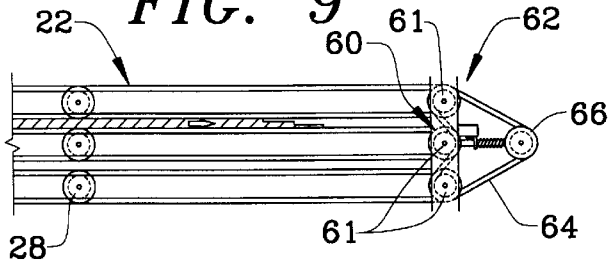
FIG. 9 is a side elevation section view of one end of the loose copy storage unit of FIG. 2 fitted with diverter conveyors.
Figure 10:
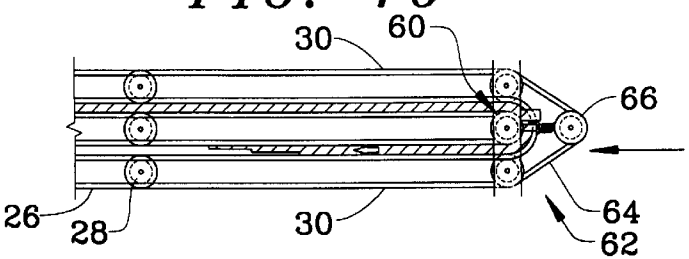
FIG. 10 is a modified view of FIG. 9 with a portion of the partially overlapped stream of newspapers positioned within a diverted end.

In FIGS. 9 & 10, the loose copy storage unit is optionally equipped with diverter conveyors 62. The diverter conveyors 62 are arranged about the ends of the stacked conveyors 22 to form a continuous serpentine conveyor path similar to the arrangement of the diverter plates 42 described, above. In addition to the stacked conveyor components, the diverter conveyors comprise a set of endless loop bands 64 and a spring loaded roller 66. The spring loaded roller 66 is positioned in-line with the axes of the respective stacked conveyor rollers and just beyond the end roller 61 of each diverted end 60 of a stacked conveyor 22. The bands 64 for the diverter conveyor 62, positioned about a diverted end 60 of a particular stacked conveyor 22, are looped in a spaced apart parallel arrangement around the end rollers 61 of the conveyors above and below the diverted end 60 of the stacked conveyor 22 and the spring loaded roller 66, see FIG. 11. Since all the end rollers 61 of the vertically stacked conveyors 22 are substantially in vertical alignment, the positioning of the bands 64 around the end rollers of the adjacent conveyors pulls the bands 64 against the conveyor path side of the end roller 61 of the diverted end 60 of the stacked conveyor.

As shown in FIG. 10, when the stream S passes around the end roller, the spring loaded roller 66 yields inwardly, toward the diverted end 60 of the stacked conveyor 22, enabling the bands 64 to move apart from the end roller to accommodate the passing stream S. The tension induced in these bands 64 by the spring loaded roller 66 forces the bands to hold the passing stream S firmly against the surface of the stacked conveyor 22 as it passes from the top side of the conveyor around the diverted end 60 to the bottom side.

Figure 11:
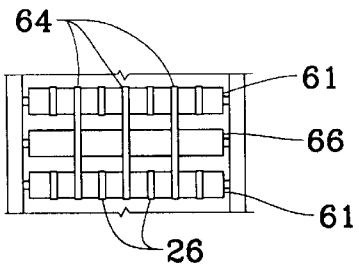
FIG. 11 is an end elevation section view of the loose copy storage unit of FIG. 9.

FIG. 11 shows the alternating position of the diverter conveyor bands 64 and the stacked conveyor bands 26 about a series of end rollers 61 and the spring loaded roller 66. The diverter conveyor bands 64 are spaced along the width of the conveyor path to adequately support and guide the stream S as it passes around the end roller 61 of the stacked conveyors.

Figure 18:
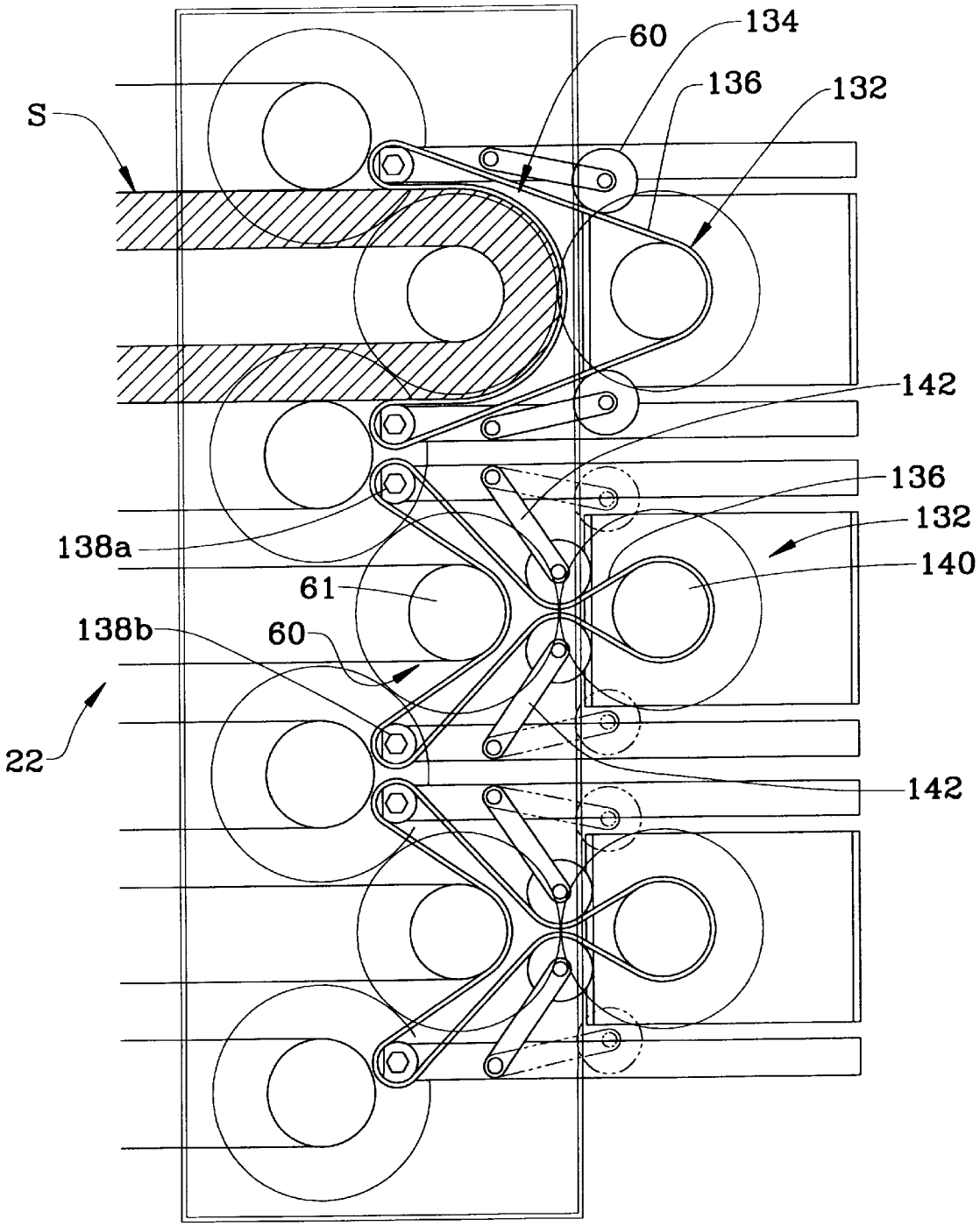
FIG. 18 is a side elevation section view of one end of the loose copy storage unit of FIG. 2 fitted with an alternative type of diverter conveyors.

FIG. 18 depicts an alternative type of diverter conveyor 132. These alternative type of conveyors are alternately arranged about the diverted ends 60 of the stacked conveyors in a similar fashion as described above. These alternative type of diverter conveyors have at least one tension roller 134 for providing tension on the diverter conveyor belts or bands 136. Preferably, these diverter conveyor will comprise a substantially full width belt looped around a pair of idler rollers 138(*a*&*b*) positioned above and below the diverted end roller 61 and around a drive roller 140 positioned in-line with the axes of the respective stacked conveyor rollers and just beyond the end roller 61 of each diverted end 60 of a stacked conveyor 22. The end rollers 61 of the conveyors vertically adjacent the diverted end may be inwardly offset to accommodate the idler rollers 138(*a*&*b*) for the adjacent diverter conveyors 132.

At an intermediate position between each of the idler rollers 138(*a*&*b*) and the drive roller 140, there is positioned a tension roller 134 which contacts the outside of the belt. Each of these tension rollers 134 are mounted on a spring loaded pivot arm 142. The tension rollers 134 maintain tension in the belts or bands 136 as they move away from the end roller 61 to accommodate and guide the passing stream S.

Each vertical column 72 of stacked conveyors 22 in the loose copy storage unit 14 may have an input and output 74, see FIG. 2. Alternatively, the columns may be joined to form a continuous storage unit sharing a single input and output 74. Since the system is reversible, each input can also serve as an output and a given unit need only have one point serving as both an input and an output. Alternatively, a unit may have multiple input/outputs.

Figure 3:
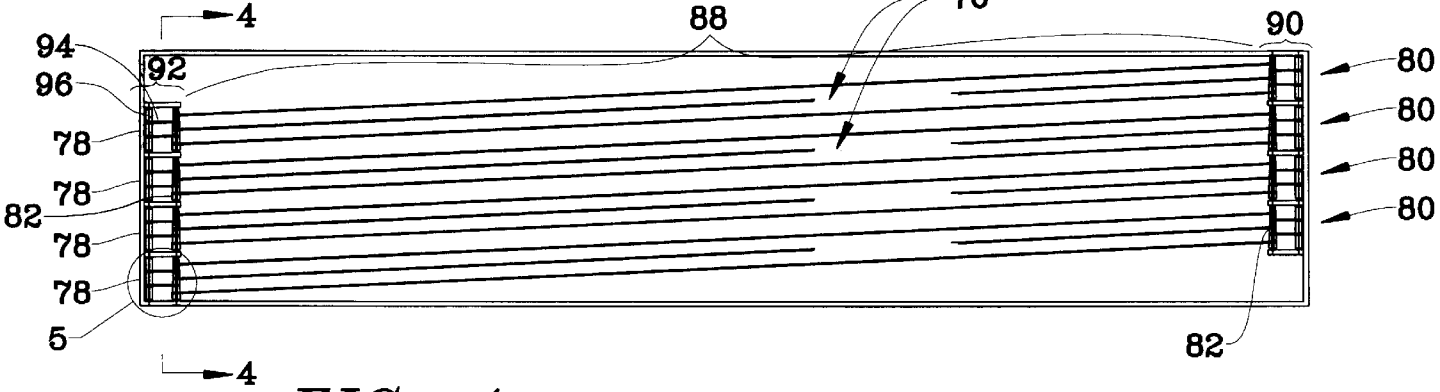
FIG. 3 is a plan view of the cross-over conveyors of the loose copy storage unit of FIG. 2, intermediate idler rollers not shown.
Figure 4:
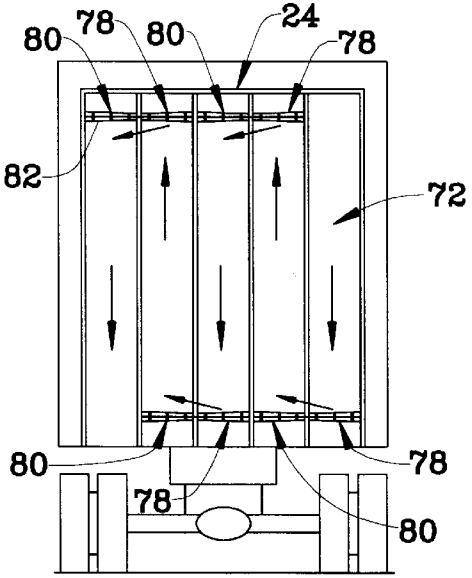
FIG. 4 is an end elevation view of the cross-over conveyors taken along line 4—4 of FIG. 3, intermediate conveyors and idler rollers not shown.

As shown in FIGS. 3 & 4, each vertical column 72 in a multiple column loose copy storage unit can be joined to the adjacent column by a cross-over conveyor 76, positioned at either the top or the bottom at one end of the column 72. The cross-over conveyors 76 may be any type of conveyor suitable for this purpose including a laterally flexible conveyor.

Preferably, the cross-over conveyor 76 will be a diagonal conveyor having one end 78 aligned with the output end of one column 72 and the opposite end 80 aligned with the input end of the adjacent column 72. These output and input ends of adjacent columns 72 are both either at the top or the bottom of the stacked conveyors, as best shown in FIG. 4. Therefore, the joined adjacent columns 72 will convey the stream in vertically opposite directions. For example, one will convey the stream upward while the adjacent conveyor conveys the stream downward.

Although there is no practical limit to the number of adjacent columns that may be joined in this manner, the number of continuously joined columns in a given storage unit may be determined by the width of each column and the overall space available, for example cargo space in a vehicle, for placement of the unit. Thus, if the input and output 74 for the first column 72 of a multiple column loose copy storage unit 14 is positioned at the top, there will be cross-over conveyors 76 positioned at the output end on the bottom of the odd number columns, counting the conveyor with the input as the $1^{st}$ column. Similarly counting from the $1^{st}$ column, there will be cross-over conveyors 76 positioned at the output end on the top of the even numbered columns.

These cross-over conveyors 76 form a continuous path for the stream S to enter the input on the $1^{st}$ column travel down the column onto the cross-over conveyor 76 to the input end of the $2^{nd}$ column and up to the cross-over conveyor that leads to the input end of the $3^{rd}$ column. This up and down travel through the joined columns of stacked conveyors continues to the end of the path at the end of the last conveyor of the last column. This end may be either at the top or the bottom of the column depending on the arrangement of the stacked columns. Since the stream can be reversed by operating all the conveyors in the opposite direction, the end of the path on the last column of conveyors may be closed off, for instance if the end is inaccessible, or may be a second input/output point for the storage unit 14.

Figure 5:
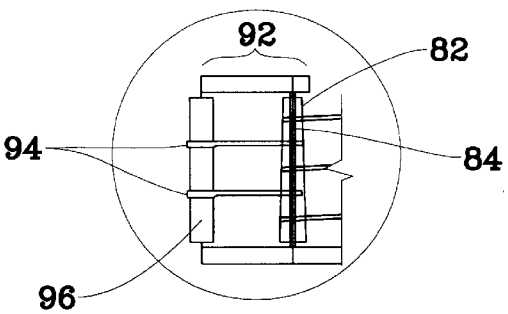
FIG. 5 is an enlarged sectional view of a tapered end roller for a cross-over conveyor taken along section V of FIG. 3.

The cross-over conveyors 76 comprise three section: two transition sections 90 and 92 at each end and a main section 88 positioned therebetween, as best shown in FIG. 3. The main section 88 comprises a series of idler rollers and a set of bands similar to the stacked conveyors 22. The difference is that the main section has two oppositely directed tapered end rollers 82. These tapered end rollers 82, as best shown in FIG. 5, are designed to provide the necessary angle for the cross-over conveyor to align with opposite ends of adjacent columns 72. The axes 84 of these tapered rollers will preferably be parallel to the axes of the rollers in the respective stacked conveyors and positioned inside of the two vertical planes defined by the ends of the stacked conveyors.

As shown in FIG. 5, the transition section 92, having an opposite orientation than that of transition section 90, comprises a set of bands 94 extending around the tapered end roller 82 and a non-tapered roller 96, on the same level as the main section, having an axis substantially parallel to the rollers of the stacked conveyors and positioned in the vertical plane defined by the ends of the stacked conveyors, in the respective column. If the system comprises diverter conveyors, the non-tapered roller 96 will preferably be part of a diverter conveyor for guiding the stream S from the end of the last conveyor of the respective column onto the cross-over conveyor and vice versa. The varying surface speed across the length of the tapered roller aids in the transition of the stream S from the stacked conveyors to the diagonal conveyor and back to the stacked conveyors.

Figure 12:
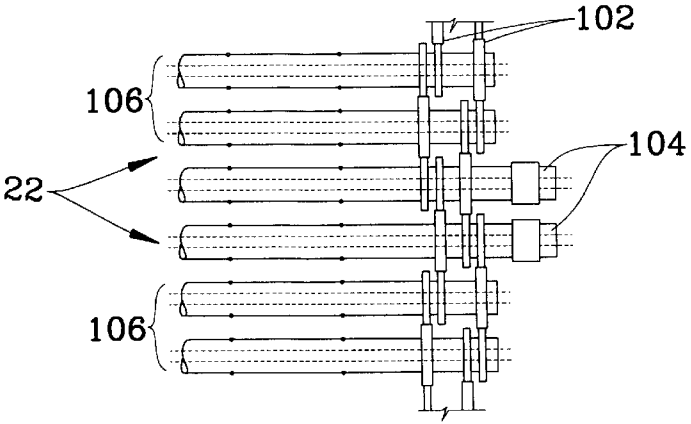
FIG. 12 is an end elevation section view showing the mechanical linkage between the stacked conveyor of the loose copy storage unit of FIG. 2 with friction drive contact points.

The loose copy storage unit can be powered by any suitable means. Preferably, the stacked conveyors 22 in the unit will be mechanically linked so they can be synchronously gang driven by a single power source, as shown in FIG. 12. The stacked conveyors can be mechanically linked by a series of drive belts or chains 102 joining the power driven rollers 104 with the slave driven rollers 106. Since the path through the stack of conveyors is a serpentine path, every other conveyor in the stack travels in the same direction and adjacent conveyors travel in opposite directions. Preferably, all the conveyors in the stack that travel in the same direction are mechanically linked by drive belts or chains 102 extending from a driven roller 104 or 106 of a conveyor on the opposite side of an adjacent conveyor, with either the outside or no portion of the drive belt or chain 102 contacting the driven roller 104 or 106 of the, intermediate, adjacent conveyor.

Figure 13:
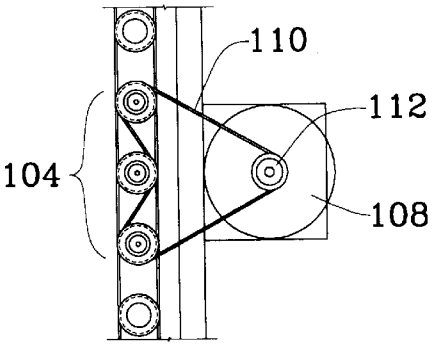
FIG. 13 is a side elevation view of the loose copy storage unit of FIG. 2 with motor drive linkage.
Figure 14:
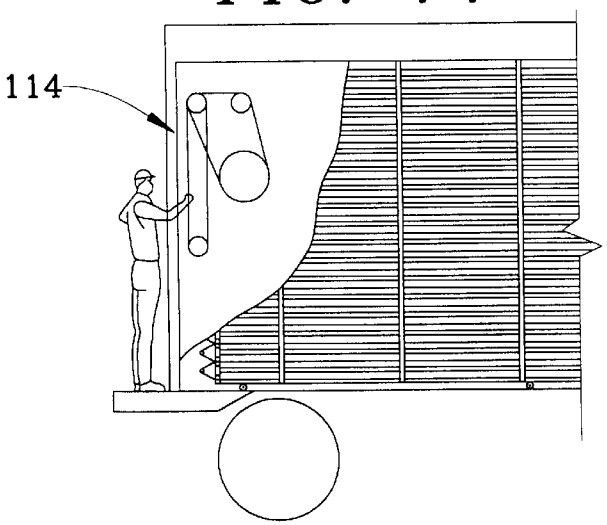
FIG. 14 is a side elevation view, partially in section, of the loose copy storage unit of FIG. 2 with a manual drive linkage.

The stacked conveyors-can be driven by a variable speed motor 108 linked by a belt or chain 110 to a group of end rollers. Preferably, the drive belt or chain 110 will be looped in a S-configuration around three adjacent power driven rollers 104 and a drive pulley 112 powered by the motor 108, as shown in FIG. 13. The stacked conveyors may optionally be equipped with a backup manually operated drive linkage 114 as shown in FIG. 14.

Figure 15:
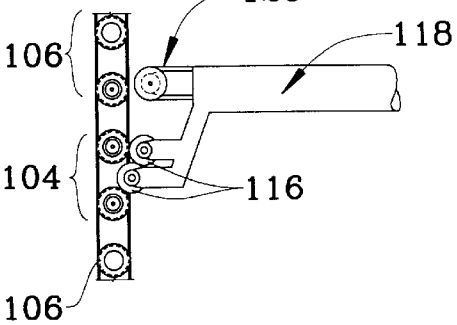
FIG. 15 is a side elevation section view of the loose copy storage unit of FIG. 12 and an output end of a transfer conveyor equipped with friction drive rollers.

Another option, as depicted in FIG. 15, is for the stacked unit to be friction driven by drive rollers 116 from a remote source. For example, the outlet end of the transfer conveyor 118 running from the printing press (not shown) may be equipped with a set of drive rollers 116 positioned proximate with the output end of the transfer conveyor 120. As the input of stacked conveyors is longitudinally aligned with the output end of the transfer conveyor, the drive rollers 116 will frictionally engage a set of power driven rollers 104 on the stacked conveyor unit. Once engaged, the stacked conveyor unit will synchronously operate with the transfer conveyor.

Figure 17:
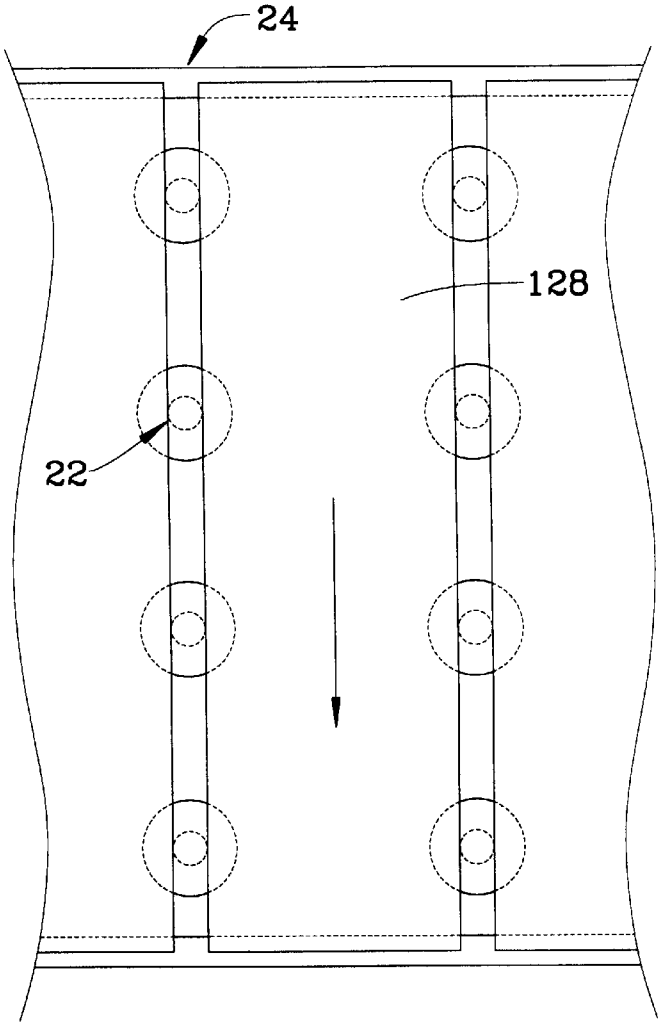
FIG. 17 is a side elevation section view of a side divider plate for the loose copy storage unit of FIG. 2.
Figure 16:
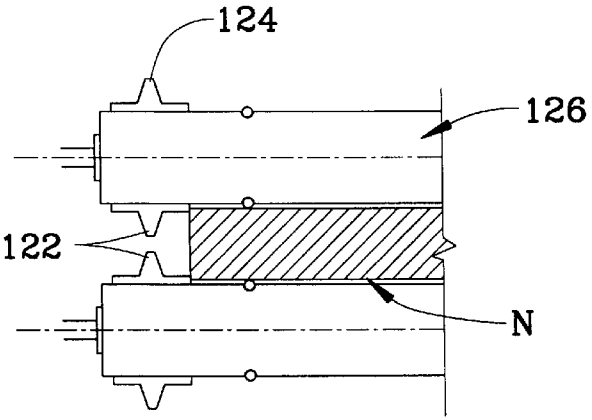
FIG. 16 is an end section view of guide belts positioned on a roller of the loose copy storage unit of FIG. 2.

The stacked conveyors may be equipped with dividers. The dividers will assist in guiding the newspapers along the conveyor path and prevent misaligned papers in one stack from interfering with adjacent stacks. Any suitable type of dividers can be used. Dividers can be guide bands 122 with a raised ridge 124 extending outwardly as shown in FIG. 16. The guide bands are mounted toward the ends of the conveyor rollers 126 outside the support bands and the area where the newspapers N travel. As depicted in FIG. 17, dividers may also be removable divider panels 128 mounted on the sides of the stacked conveyors 22. The frame 24 of the storage unit 14 can be designed so the divider panels 128 can be easily inserted and removed for maintenance.

While a particular configuration has been depicted and described, the above description is intended to convey an understanding of the present invention. Modifications within the scope of the invention will be obvious to those skilled in the art. Therefore, the scope of the invention should be determined solely by reference to the appended claims.

What is claimed is:

1. A method for remote delivery of loose copy supplied from a printing press, comprising:

providing at least one loose copy storage apparatus, comprising:

means for receiving a stream of said loose copies from the printing press; and means for storing said received loose copies in a substantially fixed relationship within said stream, said storing means comprising:

means for supporting opposing surfaces of said loose copies; and means for firmly holding each loose copy against said supporting means;

delivering loose copy from the printing press to the storage apparatus and storing the loose copy in the storage apparatus, said opposing surfaces of said loose copy being supported during said storing step; and dispensing select quantities of said loose copies from said storage apparatus.

2. The method of claim 1, comprising the step of supporting the storage apparatus in a vehicle during the delivering and storing steps.

3. The method of claim 1, wherein the storing step stores the loose copy in overlapping stream.

4. The method of claim 1, wherein the storing step stores the loose copy in spaced apart segments.

5. The method of claim 1, wherein the dispensing step dispenses an individual quantity of loose copy.

6. The method of claim 1, wherein the dispensing step dispenses a plurality of loose copy.

7. The method of claim 1, wherein the rate of speed of the loose copy delivered from the printing press and the rate of speed of the delivery of the loose copy to the storage apparatus are adjustable to vary the overlap in the loose copy during storage.

8. The method of claim 1, wherein the support means are opposing conveyor runs and the loose copy is held firmly between the opposing conveyor runs.

* * * * *